United States Patent [19]

Hansen

[11] Patent Number: 4,776,257

[45] Date of Patent: Oct. 11, 1988

[54] AXIAL PUMP ENGINE

[75] Inventor: Gunnar L. Hansen, Agertoften, Denmark

[73] Assignee: Danfoss A/S, Nordborg, Denmark

[21] Appl. No.: 165,825

[22] Filed: Jan. 19, 1988

Related U.S. Application Data

[63] Continuation of Ser. No. 873,400, May 21, 1986, abandoned.

[30] Foreign Application Priority Data

Jun. 3, 1985 [DE] Fed. Rep. of Germany ..... 3519783

[51] Int. Cl.[4] ..... F01B 3/00

[52] U.S. Cl. ..... 92/12.2; 91/499; 92/57; 92/71; 417/222

[58] Field of Search ..... 92/12.2, 57, 71, 147, 92/167; 91/499; 417/222

[56] References Cited

U.S. PATENT DOCUMENTS

| | | | |
|---|---|---|---|
| 1,345,614 | 7/1920 | Manker | 92/71 |
| 2,672,095 | 3/1954 | Lucien | 92/80 |
| 3,188,971 | 6/1965 | Puryear | 417/222 |
| 3,249,052 | 5/1966 | Karlak | 92/12.2 |
| 4,012,994 | 3/1977 | Malmros | 92/57 |
| 4,029,367 | 6/1977 | Schwede | 92/12.2 |
| 4,363,294 | 12/1982 | Searle | 92/70 |
| 4,515,067 | 5/1985 | Heyl | 92/12.2 |
| 4,581,980 | 4/1986 | Berthold | 92/12.2 |

FOREIGN PATENT DOCUMENTS

| | | | |
|---|---|---|---|
| 557371 | 5/1957 | Belgium | 92/71 |
| 620634 | 5/1961 | Canada | 92/71 |
| 113274 | 6/1984 | Japan | 92/12.2 |

*Primary Examiner*—Abraham Hershkovitz

*Attorney, Agent, or Firm*—Wayne B. Easton; Clayton R. Johnson

[57] ABSTRACT

The invention relates to an adjustable axial piston engine having spaced apart end walls with a shaft extending between the end walls. A rotary carrier is attached to the shaft adjacent one of the end walls and an oblique adjusting plate is mounted adjacent the other end wall. A piston-cylinder unit extends between the carrier and the oblique plate. A pivot axis for the oblique plate includes a bearing arrangement between the plate and the adjacent end wall. A servo unit for adjustably rotating the plate about the pivot axis is provided between the plate and the adjacent end wall. The piston-cylinder unit is carried by the carrier and is slidably engageable with the oblique plate. Flanges are provided for the piston-cylinder units which are spring biased into engagement with the oblique plate via a spring biased pressure plate.

8 Claims, 3 Drawing Sheets

AXIAL PUMP ENGINE

This application is a continuation of application Ser. No. 873,400 filed May 21, 1986, now abandoned.

The invention relates to an axial piston engine comprising at least one piston-cylinder unit, the first working element of which that bounds the space swept by the piston is held on a carrier and the second is supported on an inclined plate by way of a spring-biased slide face, the carrier and inclined plate being relatively rotatable about an axis and the slide face being adapted to the inclined plate by means of a pivot joint.

In a know axial piston engine of this kind (U.S. Pat. No. 2,672,095), the fixed carrier is provided on a circular track with cylinder bores in which cylindrical pistons are guided over their entire length. The free ends of the pistons are connected by a ball joint to a slide face suppported on a rotating inclined plate. The slide face is formed by the sectioned face of a hemisphere which forms the ball joint together with a ball socket secured to the piston. A pressure plate biased by a central helical spring by way of a ball joint presses the slide faces against the inclined plate and for this purpose has recesses through which the pistons pass. In this construction, because the piston and ball joint are disposed behind each other, the axial length cannot be decreased.

An axial piston engine is also known (U.S. Pat. No. 4,363,294), in which the carrier having the cylindrical bores and the inclined plate to which the pistons are screwed tight rotate in the same sense. An annular sealing face co-operating with the cylinder bore and corresponding to the equatorial zone of a spherical surface is secured to a sleeve which is displaceable radially to the piston with the aid of a guide. Although this permits an axially short construction of the piston-cylinder unit, it leads to a complicated and more expensive construction and, because of the radially displaceability, to difficulties in sealing.

The invention is based on the problem of providing an axial piston engine of the aforementioned kind that can be of an axially shorter construction.

This problem is solved according to the invention in that the slide face is formed at the end of the second working element and this working element is radially movable, and that the pivot joint is formed by the bore of the cylinder at an annular sealing face on the piston corresponding to the equatorial zone of a spherical surface.

In this construction, the second working element, i.e. the cylinder or the piston, rests on the inclined plate without interposing a pivot point. The pivot point is disposed within the cylinder. This results in a shorter length. The size of the slide face can be freely chosen. In the pivot bearing, no axial pressure forces need be transmitted, so that friction is reduced. However, in order to adapt the slide face to the inclined plate, the entire second working element has to be pivoted. For this purpose, a radial guide is provided which permits the second working element to be constantly perpendicular to the surface of the inclined plate. No movable elements are necessary on the piston itself, so that an excellent seal is obtained.

If the spring force is exerted by a central spring acting on the second working elements by way of a pivotably mounted pressure plate having cut-outs for receiving the second working element, the piston-cylinder units can be made even shorter because no axial space is necessary for the springs to be associated with the individual units. The central spring may be arranged within the ring of piston-cylinder units.

It is favourable for the cut-outs to be in the form of a radial guide for the second working elements. This results in a very simple construction without accessories.

Further, the pressure plate may be planar and cooperate with planar collar surfaces at the second working elements. This is likewise a simple and space-saving construction.

With particular advantage, the central spring surrounds a rotatable shaft, is supported on the one hand by a carrier which is fixed to turn with the shaft but is axially displaceable, presses the carrier against an end face of the housing, and is supported on the other hand by a collar of the shaft which, in turn, acts on the pressure plate by way of a ball joint. One and the same spring will then ensure that the carrier lies sealingly against the end face of the housing and that the slide faces rest securely on the inclined plate. At the same time, this fixes the axial position of the shaft.

In particular, the ball joint is formed by a collar of the shaft having a spherical annular face and a complementary bearing face at the edge of a central aperture of the pressure plate through which the shaft passes. This likewise requires a short axial constructional length.

With advantage, the sealing face is formed by a belt having a spherical top surface and held against a step of the piston by means of a ring that is crimped tight. This annular belt need only have a shallow height corresponding to the pivot angle.

It is favourable if the second working elements have a passage extending up to the end. This will result in relieving the slide face and permits the slide face to act as a hydrostatic bearing.

When using the piston as the second working element, the slide face should project beyond the cross-section of the piston and be provided in the end with pressure-relieving depressions extending from the passage. Under optimum conditions, these pressurerelieving depressions extend over the entire piston section so that the slide face will be loaded only by way of the pressure plate but hardly at all by the pressure in the space swept by the piston.

When using the cylinder as the second working element, it is preferred that the cylinder bore should extend to the end and contain an insert which, at the side facing the inclined plate, comprises a pressure relief pocket and with its circumferential face bounds a throttle gap of which the end is connected to the outside of the cylinder by way of a passage in the end face of the cylinder. Here, again, there is practically no load at all on the cylinder. The reduction in pressure takes place principally along the throttle gap so that the slide face is no longer loaded by pressure of the pressure fluid.

Preferred examples of the invention will now be described in more detail with reference to the drawing, wherein.

Figure 1:
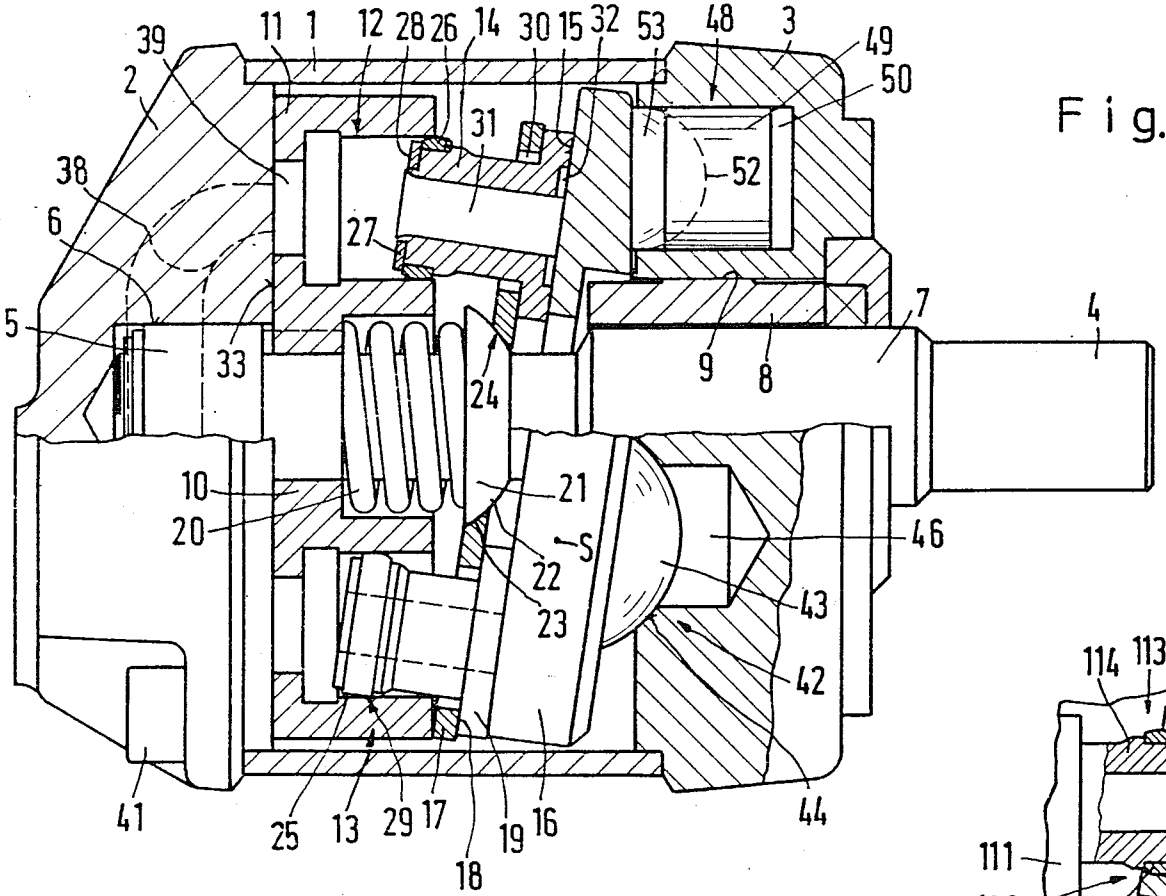
FIG. 1 is a longitudinal section through a first embodiment of the invention.

The axial piston engine shown in FIG. 1 may operate as a motor or as a pump. Its housing comprises two end or transverse walls 2 and 3 interconnected by a peripheral wall 1. A shaft 4 is held by its end 5 in a bearing bore 6 of the transverse wall 2 and by its section 7 in a bearing bush 8 in the transverse wall 3. This bearing bush 8 is fixed with respect to the housing only along a part 9 of its circumference so that the shaft 4 has a certain amount of mobility.

By way of a gear coupling 10, the shaft 4 is connected to a carrier 11 to rotate therewith but to be axially displaceable. The carrier comprises a plurality of bores which serve as cylinders 12 of piston-cylinder units 13. A piston 14 engaged in each of these cylinder bores carries at its end a slide face 15 by which it is supported on an inclined plate 16. A planar pressure plate 17 lies on planar faces 18 of collars 19 on the piston 14 and is biased by a central spring 20 which is supported on the one hand at the carrier 11 and on the other hand at a collar 21 of the shaft 4. This collar has a spherical annular face 22 which forms a ball joint 24 together with a complementary bearing surface 23 at the rim of a central aperture of the pressure plate 17 through which the shaft 4 passes.

At its end remote from the inclined plate, the piston 14 has an annular sealing face 25 which corresponds to the equatorial zone of a spherical surface with a diameter equal to that of the bore of the cylinder 12. It is disposed at the top surface of a belt 26 which is held against a step 28 of the piston by means of a ring 27 that is crimped fast. In conjunction with the bore of the cylinder 12, this sealing face forms a displaceable pivot joint. The pressure plate 17 has cut-outs 30 in the form of an elongate radial hole and therefore forming a radial guide for the piston 14. In this way, the slide face 15 can lie fully against the inclined plate 16 in every rotary position of the carrier 11 despite the axial shortness of the piston-cylinder unit 13.

Each piston 14 comprises a through-passage 31 in the form of a bore. In addition, an annular depression 32 at the end has an outside diameter substantially equal to the piston diameter in the cylinder 12. This results in substantial pressure relief so that the piston is pressed against the inclined plate 16 substantially only under the force of the central spring 20. At the same time, hydrostatic lubrication is obtained for the side face, so that the frictional losses are low.

In its end face 33, the transverse wall 2 comprise two part-annular grooves, namely a vacuum groove 34 and a pressure groove 35. These are each connected to a respective vacuum connection 36 and pressure connection 37 at the outer end of transverse wall 2 by way of the diagrammatically indicated passages 38. The cylinders 12 have at their end control orifices 39 with which they are moved alternatively along the vacuum groove 34 and the pressure groove 35. In this way, the spaces in the piston-cylinder units 13 swept by the pistons can be charged and discharged. The preferred direction of rotation is shown by an arrow 39. Clamping screws 41 for holding the housing parts 1 to 3 together are passed through holes 40.

Figure 3:
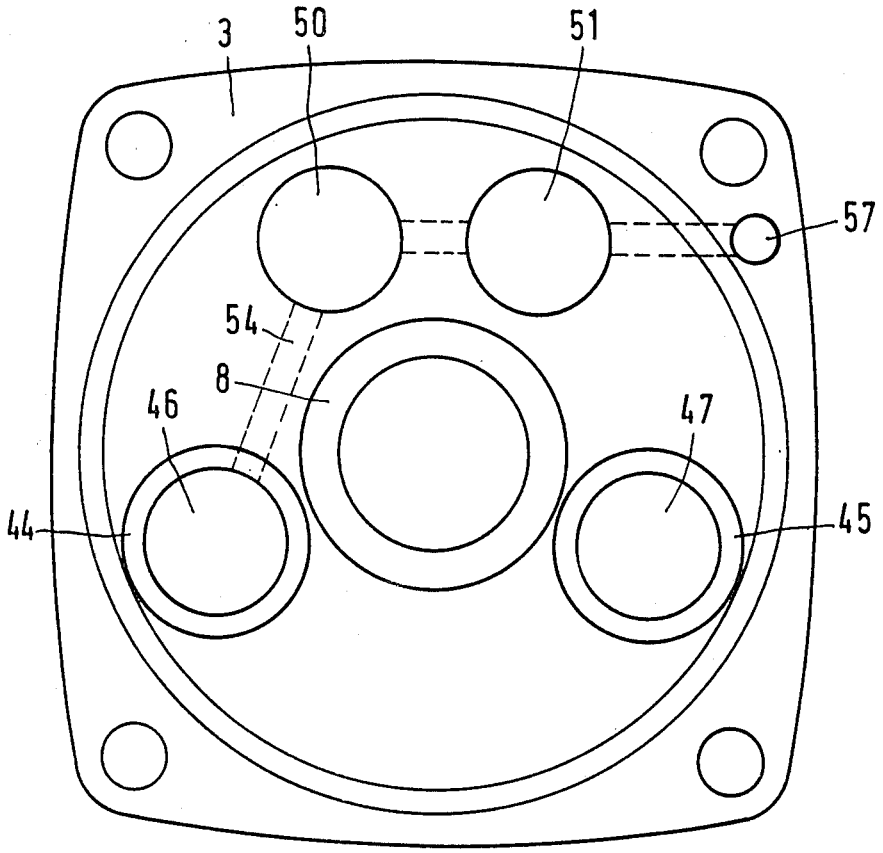
FIG. 3 is an elevation from the left hand side onto the right hand transverse wall of the housing of FIG. 1.

The inclination of the inclined plate 16 is adjustable to vary the displacement of the engine when working as a pump or the rotary speed of the engine when working as a motor. For this purpose, the inclined plate 16 is pivotably mounted in a slide bearing 42 about a pivot axis S, the slide bearing taking up only part of the surface of the inclined plate 16 and the transverse wall 3. This slide bearing is formed by a bearing element in the form of two spherical members 43 on the inclined plate 16 and two complementary bearing cups 44 and 45 (FIG. 3). The spherical bearing members and cups are offset from each other in the direction of the pivotal axis S. The bearing cups are disposed near the diametral line of the transverse wall 3 to both sides of the shaft bearing formed by the bushing 8. The bearing cups 44 and 45 have a chamber 46 or 47 within an annular bearing surface.

Further, two servo-devices 48 are provided on the same side of the inclined plate 16 as is the slide bearing 42, namely adjacent to said slide bearing. Each servo-device consists of a servo-piston 49 and a servo-cylinder 50 or 51 (FIG. 3). The servo-cylinders are in the form of bores in the transverse wall 3. Each servo-piston piston is provided at its outer end with a spherical depression 52 in each of which there is engaged a spherical concave member 53 which makes frictional contact with inclined plate 16. Its diameter corresponds to that of the servo-cylinder bore.

The chamber 46 of the bearing cut 44 arranged opposite the pistoncylinder units 13 under pressure communicates by way of a passage 54 with both piston chambers of the servo means 48 and is likewise fed with a regulated pressure communicates by way of a passage 54 with both piston chambers of the servo means 48 and is likewise fed with a regulated pressure by a regulating device. This pressure is applied to the servo means and the chamber 46 by way of a connector 55 at the transverse wall 2 and a passage system comprising bores 56 and 57. Depending on this pressure or the amount of fluid enclosed in the chambers, the inclined plate 16 will assume a particular inclination. At least the pressure-loaded slide bearing 42 is hydrostatically supported so that little resistance is offered to the pivotal motion. This servo device for the inclined plate likewise has a very short axial length. The construction is simple. Since the bearing members 42 and 53 are pressed into the bearing cup 44 or depression 52 of the piston 49 by the spring 20, the inclined plate 16 is also securely locked in the transverse direction.

Figure 4:
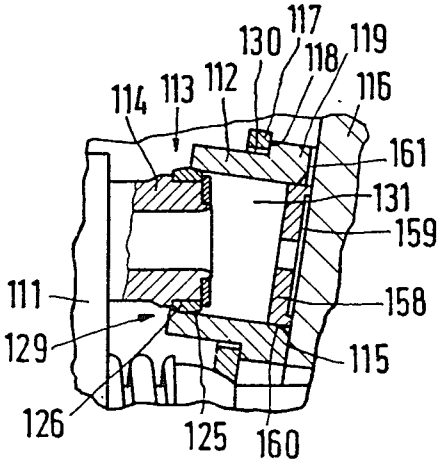
FIG. 4 is a longitudinal part section of a modified embodiment.
Figure 2:
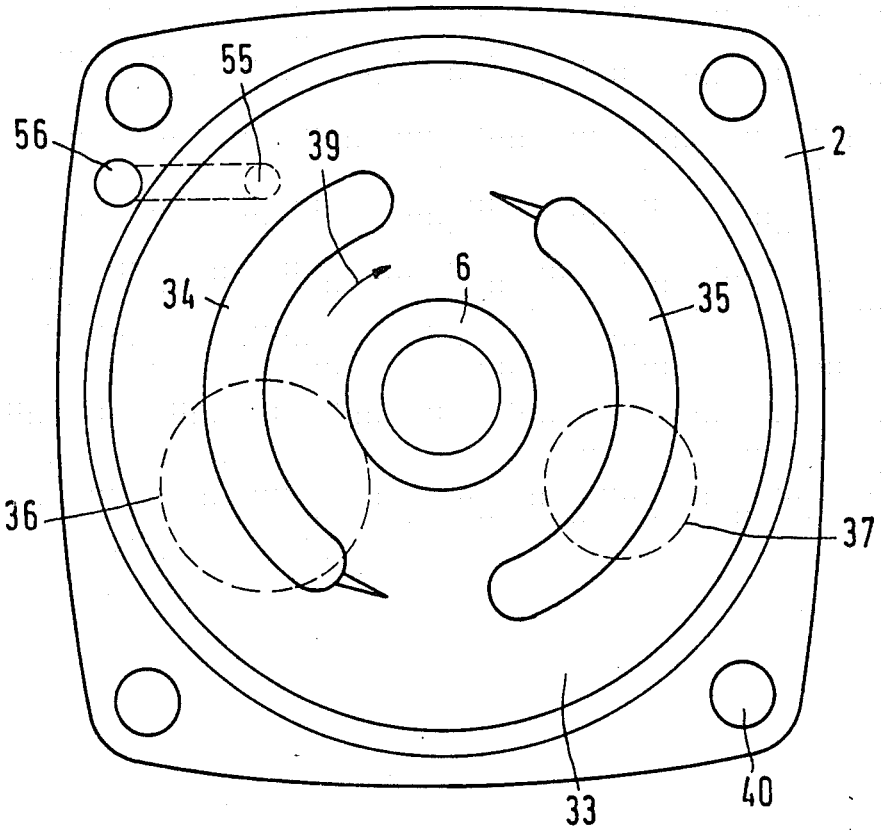
FIG. 2 is an elevation from the right hand side onto the left hand transverse wall of the housing of FIG. 1.

In the modification of FIG. 4, corresponding integers are provided with reference numerals increased by 100 relatively to FIG. 1. The main difference is that for each piston-cylinder unit 113, the piston 114 is connected to the rotating carrier 111 and the cylinder 112 has the slide face 115 at its end face. The piston 114 is, as in FIG. 1, provided with a belt 126 having an annular sealing face 125 corresponding to the equatorial zone of a spherical surface with the diameter of the bore of the cylinder 112. This cylinder 112 is radially guided in the recess 130 of pressure plate 117 that is in the form of an elongate radial hole. An insert 158 in the throughgoing cylinder bore 131 has a pressure relieving pocket 159 at the side facing the inclined plate 116. A gap 160 is formed between its circumferential surface and the cylinder bore. At least one passage 161 provided in the end face of cylinder 112 leads from a chamfer provided at the cylinder bore to remove burrs to the outside of the cylinder. Accordingly, the entire pressure drop occurs along this gap 160 towards the outside. The cylinder 112 is therefore substantially free from pressure.

Each of the cylinders 12, 112 and pistons 14, 114 have a central axis. Further as may be seen from FIGS. 1 and 4, the flat, annular slide surface 15 is fixed relative to the central axis of the piston 14 and the annular spherical surface portion 25 while the flat, annular slide surface 115 is fixed relative to the central axis of cylinder 112 but not relative to the annular spherical surface portion 125 of the piston 114. Also, in the FIG. 1 embodiment the slide surface 15 is at one terminal end of the piston 14 while surface portion 26 is at the opposite end portion and is in fixed angular relationship to slide surface 25. In the FIG. 4 embodiment the slide surface 115 is at one terminal end of the cylinder 112 and is in fixed angular relationship to the opposite terminal end of the cylinder 112.

What is claimed is:

1. An adjustable axial piston engine, comprising a housing having first and second end walls in spaced apart relationship having respective aligned bearings, a shaft mounted in said bearings for rotation about a first axis, an oblique plate member having a pivot axis and a slide surface, said oblique plate member being disposed adjacent to said second end wall in surrounding relation to said shaft and movable relative to said shaft about said pivot axis, a piston cylinder unit having relatively pivotable piston and cylinder elements, carrier means mounted on said shaft in surrounding relationship thereto for being rotated therewith and being adjacent to said first end wall for rotation about said first axis, one of said elements being carried by said carrier means and the other of said elements having an end portion that includes means defining a slide face slidably engaging the slide surface, each of said elements having a central axis, the cylinder element having an axial bore and the piston element having a spherical surface end portion in said bore that is of the same diameter as that of said bore and is axially movable in said bore and also pivotably movable relative to the cylinder element about axes other than the central axes of the elements, a pressure plate disposed between the carrier means and the oblique plate member and having a central bore through which the shaft is extended to permit the pressure plate pivoting relative to the shaft and the first axis and a guide hole radially spaced from the plate central opening for having said other element extended therethrough and forming a radial guide to permit the other element being maintained perpendicular to the slide surface, said shaft having a collar thereon that forms a ball pivot for abutting against the pressure plate, spring means between said carrier means and said collar and surrounding the shaft for biasing the said other element and thereby the slide face against the plate member via said pressure plate, pivot axis means for the plate member on one side of said shaft including bearing means between the plate member and said second end wall, and servo means between the plate member and second end wall on the opposite side of shaft for pivoting the oblique plate about said pivot axis, the cylinder element having axially opposite ends with the bore opening therethrough, the piston element having the end portion that includes the slide face and an axially extending passage opening to the cylinder bore, the end portion that includes means defining the slide face comprising an annular flange defining an annular depression of an outer diameter substantially equal to that of the cylinder bore, the annular depression opening to the oblique plate and the piston passage to provide pressure relief so that the piston is pressed against the plate member substantially only under the force of the spring means, the annular flange having said slide face.

2. An axial piston engine according to claim 1 further characterized in that the pressure plate and the other element end portion have cooperating planar surfaces in abutting relationship.

3. An axial piston engine according to claim 1 in that the carrier means is mounted on the shaft for axial movement and that the spring means acts against the carrier means to bias the carrier means against the housing first wall.

4. An axial piston engine according to claim 3 in that the collar has a spherical annular surface and that the pressure plate has a wall portion defining the pressure plate central opening that provides a bearing surface abutting against the spherical annular surface.

5. An adjustable axial piston engine, comprising a housing having first and second end walls in spaced apart relationship having respective aligned bearings, a shaft mounted in said bearings for rotation about a first axis, an oblique plate member having a pivot axis and a slide surface, said oblique plate member being disposed adjacent to said second end wall in surrounding relation to said shaft and movable relative to said shaft about said pivot axis, a piston cylinder unit having relatively pivotable piston and cylinder elements, carrier means mounted on said shaft in surrounding relationship thereto for being rotated therewith and being adjacent to said first end wall for rotation about said first axis, one of said elements being carried by said carrier means and the other of said elements having an end portion that includes means defining a slide face slidably engaging the slide surface, each of said elements having a central axis, the cylinder element having an axial bore and the piston element having a spherical surface end portion in said bore that is of the same diameter as that of said bore and is axially movable in said bore and also pivotably movable relative to the cylinder element about axes other than the central axes of the elements, a pressure plate disposed between the carrier means and the oblique plate member and having a central bore through which the shaft is extended to permit the pressure plate pivoting relative to the shaft and the first axis and a guide hole radially spaced from the plate central opening for having said other element extended therethrough and forming a radial guide to permit the other element being maintained perpendicular to the slide surface, said shaft having a collar thereon that forms a ball pivot for abutting against the pressure plate, spring means between said carrier means and said collar and surrounding the shaft for biasing the said other element and thereby the slide face against the plate member via said pressure plate, pivot axis means for the plate member on one side of said shaft including bearing means between the plate member and said second end wall, and servo means between the plate member and second end wall on the opposite side of shaft for pivoting the oblique plate about said pivot axis, the cylinder element having axially opposite ends with the bore opening therethrough, the other element including the cylinder element which has said end portion and has the cylinder bore opening to the oblique plate member and an insert mounted by the cylinder element in the cylinder bore adjacent to the oblique plate member, the insert having a pressure relieving pocket opening to the oblique plate member, the cylinder element having an inner peripheral wall defining the cylinder bore and the insert having a circumferential surface, said peripheral wall and insert bounding a throttle gap, the cylinder element end portion having said slide face and a passage opening exterior of the cylinder element to the throttle gap and to the oblique plate member slide surface whereby the cylinder element is pressed against the oblique plate member sustantially only under the force of the spring means and the cylinder element end portion having a flange between the pressure plate and oblique plate member and bearing against the pressure plate.

6. An axial piston engine according to claim 5 further characterized in that the pressure plate and flange have cooperating planar surfaces in abutting relationship.

7. An axial piston engine according to claim 5 in that the carrier means is mounted on the shaft for axial movement relative thereto and that the spring means acts against the carrier means to bias the carrier means against the housing first wall.

8. An axial piston engine according to claim 7 in that the collar has a spherical annular sufrace and that the pressure plate has a wall defining the pressure plate central opening to provide a bearing surface abutting against the spherical annular surface.

* * * * *